US005515704A

United States Patent [19]

van Nguyen

[11] Patent Number: 5,515,704

[45] Date of Patent: May 14, 1996

[54] SECURITY LOCK FOR A DEAD BOLT LOCK ASSEMBLY

[76] Inventor: Cao van Nguyen, 115 Burwood Way, Folsom, Calif. 95630

[21] Appl. No.: 307,379

[22] Filed: Sep. 16, 1994

Related U.S. Application Data

[63] Continuation-in-part of Ser. No. 125,016, Sep. 21, 1993, abandoned.

[51] Int. Cl.[6] ..... E05B 13/00

[52] U.S. Cl. ..... 70/416; 70/211; 292/288; 292/291; 292/293

[58] Field of Search ..... 70/14, 416, 211, 70/429, 430, 462; 292/244, 288, 258, 359, 289–298

[56] References Cited

U.S. PATENT DOCUMENTS

| | | | |
|---|---|---|---|
| 827,624 | 7/1906 | Foster | 292/288 |
| 1,380,990 | 6/1921 | Lonk | 70/429 |
| 1,700,135 | 1/1929 | Lanes | 70/416 |
| 2,288,022 | 6/1942 | O'Brien et al. | 292/291 |
| 3,263,462 | 8/1966 | Suroff et al. | 70/447 |
| 3,423,974 | 1/1969 | Bernsley | 70/416 |
| 3,458,228 | 7/1969 | White | 292/359 |
| 3,748,882 | 7/1973 | Dusault, Jr. et al. | 70/416 |
| 3,773,369 | 11/1973 | Wersonick | 292/346 X |
| 3,826,117 | 7/1974 | Racobs | 70/416 |
| 3,888,096 | 6/1975 | Huss | 70/209 |
| 4,254,976 | 3/1981 | Shoberg | 292/292 |
| 4,334,705 | 6/1982 | Rumph | 292/288 |
| 4,404,826 | 9/1983 | Brill | 70/416 |
| 4,715,200 | 12/1987 | Katsaros | 70/211 |
| 4,869,086 | 9/1989 | Richards | 70/416 |
| 4,885,921 | 12/1989 | Sharay | 70/416 X |
| 4,947,663 | 8/1990 | Yeager | 70/416 |
| 5,000,498 | 3/1991 | Upchurch | 70/416 X |
| 5,003,803 | 4/1991 | Richards | 70/416 |
| 5,035,128 | 7/1991 | Ridgway | 70/416 X |
| 5,052,202 | 10/1991 | Murphy | 70/211 |
| 5,313,812 | 5/1994 | Eklund et al. | 70/416 |

FOREIGN PATENT DOCUMENTS

| | | |
|---|---|---|
| 291131 | 7/1931 | Australia . |
| 463579 | 10/1913 | France . |
| 928473 | 11/1947 | France . |
| 465864 | 9/1928 | Germany . |
| 116105 | 8/1926 | Switzerland . |
| 665769 | 1/1952 | United Kingdom . |

*Primary Examiner*—Lloyd A. Gall
*Attorney, Agent, or Firm*—Teresa J. Wiant

[57] ABSTRACT

A security lock (10) including an arm (14) and a mounting member (12) is provided for use with a dead bolt lock assembly having a lock actuator on a first side (34) of a door (32) and a turn piece (36) on a second side (38) of the door (32). When the security lock (10) is in an engaged position (42), abutting surfaces (**22*a*, 22*b*) of the arm (14) are positioned immediately adjacent the turn piece (36) to abut and restrict rotation of the turn piece (36**).

10 Claims, 6 Drawing Sheets

SECURITY LOCK FOR A DEAD BOLT LOCK ASSEMBLY

This application is a continuation-in-part of my application Ser. No. 08/125,016, filed Sep. 21, 1993, now abandoned, and entitled "THE LOCKGUARD."

TECHNICAL FIELD

This invention relates to a security lock for a dead bolt lock assembly. More particularly, this invention relates to a security lock for preventing rotation of a turn piece of a dead bolt lock assembly when the security lock is engaged.

BACKGROUND INFORMATION

A dead bolt lock assembly usually includes a cylinder for receiving a key on a first side of a door and a turn piece on a second side of the door. Both the turn piece and the cylinder are operable for extending and retracting a dead bolt from a door into a door jamb. When the dead bolt is operated by a key in the cylinder on the first side of the door, the turn piece on the second side of the door is rotated. At times it is desirable to prevent rotation of the turn piece so that the lock may not be operated from the first side of the door.

SUMMARY OF THE INVENTION

The present invention provides a security lock for use with a lock assembly mounted on a door. The lock assembly has a lock actuator on a first side of a door and a turn piece on a second opposite side of the door. The turn piece is rotatably connected to a dead bolt of the lock assembly. Activation of the dead bolt by the lock actuator causes rotation of the turn piece. The present invention comprises a mounting member and an arm. The arm has a pivotal connection to said mounting member at a first end of the arm. The arm is pivotal about the pivotal connection between an engaged position and a non-engaged position. The arm has abutting surfaces at a second and opposite end of the arm. Each abutting surface diverges from each other abutting surface such that the abutting surfaces form a notch in the second end of the arm with an angle between the abutting surfaces of less than 180°. The arm has a longitudinal length and the pivotal connection is substantially perpendicular to the longitudinal length of the arm. In use, the security lock is mountable on a door by mounting the mounting member to position the abutting surfaces adjacent a turn piece of a lock assembly when the arm is in an engaged position such that the abutting surfaces abut and restrict rotation of the turn piece.

The mounting member may further comprise a mounting plate. The mounting plate forms a circular cavity. The cavity is sized to receive a portion of the lock assembly. An escutcheon plate-receiving surface extends radially outwardly from the circular cavity. The security lock is mountable on a door by placing the mounting plate between the door and an escutcheon plate of the lock assembly such that the escutcheon plate is positioned flush against the mounting plate and the mounting plate is positioned flush against the door.

In another embodiment of the present invention, the mounting member includes a bolt-engaging finger. The bolt-engaging finger is dimensioned to permit the bolt-engaging finger to be positioned between a closed door and a door jamb. In use, the security lock is mountable on a door by fitting the bolt-engaging finger on a dead bolt of a lock assembly installed on the door when the dead bolt is in a locked and extended position. The bolt-engaging finger may further include an adjustable portion. The adjustable portion is adjustable to extend and retract the bolt-engaging finger from a housing of the mounting member. In use, the bolt-engaging finger is adjustable to place the bolt-engaging finger over a dead bolt of a lock assembly installed in a door with the abutting surfaces of the arm immediately adjacent a turn piece of the lock assembly when the arm is in the engaged position.

The security lock may further include an adjustable connection to extend and retract the abutting surfaces of the arm. In use, the adjustable connection is adjustable to place the abutting surfaces of the arm immediately adjacent a turn piece of a lock assembly installed on a door when the arm is in the engaged position.

In another embodiment of the present invention, the mounting member includes a bolt-engaging finger which is detachably connectable to a seat. The seat is mountable on a door by positioning the seat against a door jamb of the door. In use, the security lock is mountable on a door by fitting the bolt-engaging finger on a dead bolt of a lock assembly installed on a door when the dead bolt is in a locked and extended position. In addition, the security lock is mountable on a door by detaching the bolt-engaging finger from the seat and mounting the security lock by positioning the seat against a door jamb of a door and the abutting surfaces of the arm immediately adjacent a turn piece of a lock assembly installed on the door when the arm is in the engaged position.

In another embodiment of the present invention, the security lock is mountable on a door by the use of fasteners which extend through openings formed in the mounting member and into the door.

These and other objects, advantages, and features of the present invention will become apparent from the following description of the best modes of the invention, and the accompanying drawings, and the claims, which are incorporated herein by reference.

BRIEF DESCRIPTION OF THE DRAWINGS

In the drawings, like element designations refer to like parts throughout the several views, and.

BEST MODES FOR CARRYING OUT THE INVENTION

The present security invention provides a security lock which is particularly useful with a dead bolt lock assembly. The dead bolt lock assembly includes a dead bolt which extends and retracts from a door into a door jamb. The dead bolt is activated by a lock actuator located on a first side of the door and a turn piece on a second side of the door. Generally, the dead bolt lock assembly is mounted on a door such that an escutcheon plate of the lock assembly is positioned between the turn piece and the second side of the door. When the dead bolt is activated by the lock actuator on the first side of the door, the turn piece is rotated. The security lock of the present invention prevents rotation of the turn piece such that the dead bolt may not be activated by use of the lock actuator when the security lock is engaged.

Figure 1:
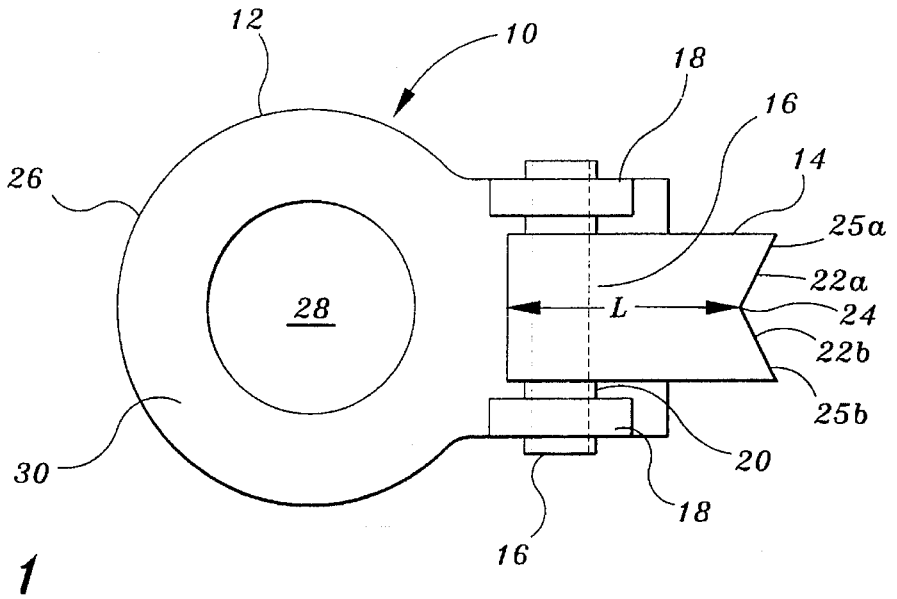
FIG. 1 is a top plan view of a first embodiment of the security lock of the present invention with an arm of the security lock in a nonengaged position.
Figure 2:
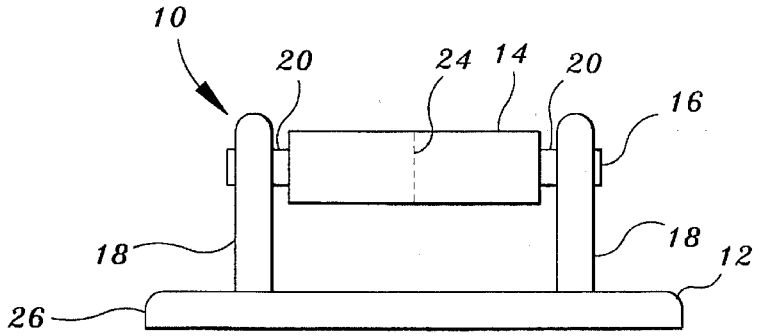
FIG. 2 is a rear pictorial view of the security lock shown in FIG. 1 with the arm in an engaged position.

Referring first to FIGS. 1 and 2, the security lock 10 of the present invention includes a mounting member 12 and an arm 14. The arm 14 is pivotally connected to the mounting member 12 by a pivot pin 16 which extends through the arm 14 and flanges 18 of the mounting member 12. Washers 20 are positioned on the pivot pin 16 between the flanges 18 and the arm 14. The arm 14 pivots on the pivot pin 16 relative to the mounting member 12.

The arm 14 includes abutting surfaces **22*a*, 22*b*. Abutting surface 22*a* diverges from abutting surface 22*b* from a central point 24 on the end of the arm 14. The angle between the abutting surfaces 22*a* and 22*b* is less than 180° such that a notch is formed between two fins 25*a*, 25*b* at the end of the arm 14. The diverging abutting surfaces 22*a*, 22*b*** may include slight curvatures and still be within the scope of the present invention.

A further aspect of the present invention is the relation of the pivotal connection of the arm 14 to the mounting member 12. As shown in FIG. 1, the arm 14 has a longitudinal length L from the pivot pin 16 to the abutting surfaces **22*a*, 22*b*. The pivot pin 16 is substantially perpendicular to the length L of the arm 14 to strengthen the security lock 10** when it is in an engaged position.

Referring to FIGS. 1–8, the first embodiment of the present invention includes a mounting plate 26 which forms a circular cavity 28. An escutcheon plate receiving surface 30 extends radially outwardly from the circular cavity 28.

Figure 3:
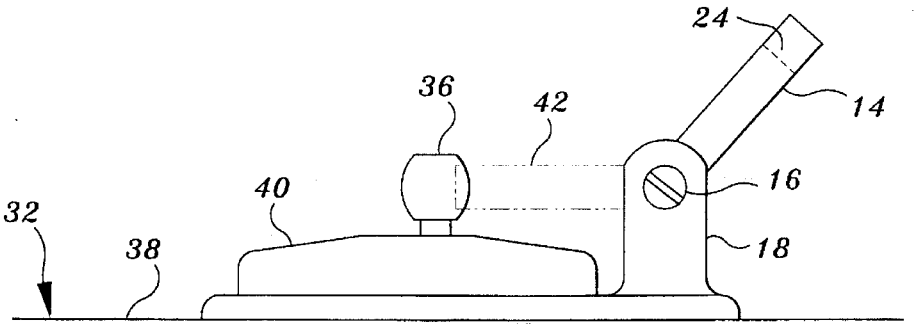
FIG. 3 is a side elevational view of the embodiment of the security lock shown in FIGS. 1 and 2 installed on a door having a dead bolt lock assembly with the arm of the security lock shown in a nonengaged position and the arm shown in an engaged position in phantom.

The first embodiment of the security lock 10 is mounted on a door 32 fitted with a dead bolt lock assembly by positioning the mounting plate 26 of the mounting member 12 on a second side 38 of the door 32 underneath the escutcheon plate 40 of the dead bolt lock assembly. As shown in FIG. 3, the escutcheon plate 40 is mounted flush against the escutcheon plate receiving surface 30 of the mounting plate 26 and the mounting plate 26 in positioned in tight engagement with the door 32 such that the escutcheon plate 40 and the mounting plate 26 are held against movement. In this way, the security lock 10 of the present invention may be installed without the use of fasteners or adhesives. When mounted, the pivot pin 16 is substantially parallel to the second side 38 of the door 32.

When the arm 14 of the security lock 10 is in an engaged position, as illustrated in phantom at 42 in FIG. 3, the abutting surfaces **22*a*, 22*b* are immediately adjacent the turn piece 36 of the dead bolt lock assembly. The abutting surfaces 22*a*, 22*b* or fins 25*a*, 25*b* prevent rotation of various size and style turn pieces. A number of sizes and style of turn pieces 36*a*, 36*b*, 36*c*, 36*d*, and 36*e* are illustrated in FIGS. 4–8**.

One important aspect of this invention is the design of the arm 14 with abutting surfaces **22*a*, 22*b* and fins 25*a*, 25*b*, respectively. Abutting surface 22*a* diverges from abutting surface 22*b* from a central point 24. The abutting surfaces 22*a*, 22*b* extend along fins 25*a*, 25*b*, respectively. A turn piece 36 may be restricted from rotational movement by contacting any point along abutting surfaces 22*a* or 22*b*. For example, referring to FIG. 4, rotational movement of turn piece 36*a* in a clockwise direction would be prevented by the turn piece 36*a* contacting abutting surface 22*b* and rotational movement of the turn piece 36*a* in a counter-clockwise direction would be prevented by the turn piece 36*a* contacting abutting surface 22*a***.

If the turn piece 36 does not fit within the notch formed by fins **25*a*, 25*b*, such as to contact abutting surfaces 22*a*, 22*b*, the security lock 10 is mounted to position fins 25*a*, 25*b* immediately adjacent the turn piece 36 such that rotational movement of the turn piece 36 is prevented by fins 25*a*, 25*b*. For example, referring to FIG. 5, if the turn piece 36*b* were to begin rotation in a clockwise direction, the turn piece 36*b* would be brought into engagement with fin 25*b* which would abut and prevent further rotation of the turn piece 36*b*. This slight movement of the turn piece 36*b* to bring it into engagement with fin 25*b* would not be sufficient to actuate the lock assembly. Similarly, if the turn piece 36*b* began to turn in a counter-clockwise direction, turn piece 36*b* would be brought into contact with fin 25*a* which would prevent further rotation of turn piece 36*b***.

Figure 4:
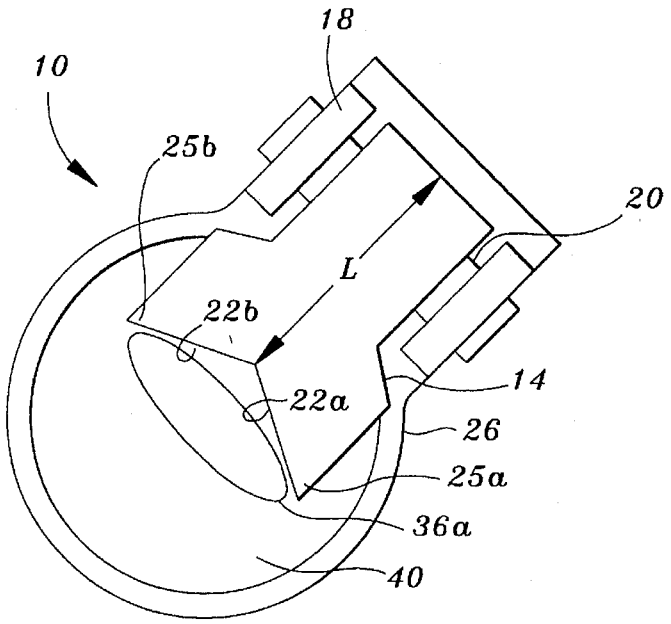
FIG. 4 is a top plan view of the security lock shown in FIGS. 1–3 with the arm in an engaged position with a lock assembly have a turn piece of a first style.
Figure 8:
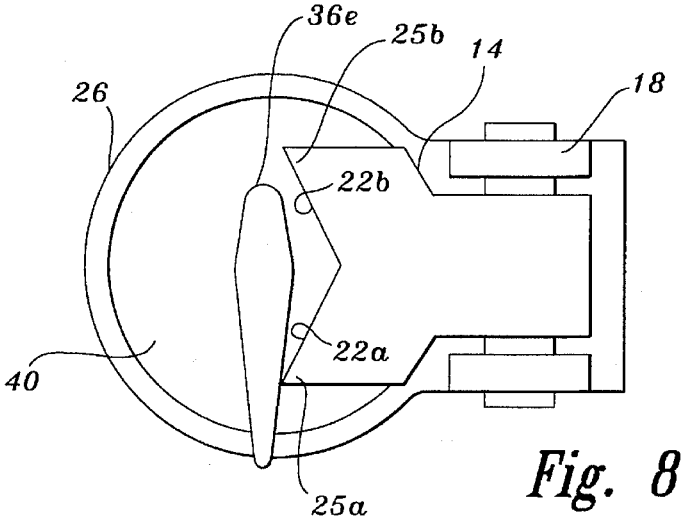
FIG. 8 is a top plan view of the security lock shown in FIGS. 1–3 with the arm in an engaged position with a lock assembly having a turn piece of a fifth style.

In a preferred form of the invention, the circular cavity 28 in the mounting plate 26 is sized to allow for movement of the mounting plate 26 relative to the escutcheon plate 40 before the mounting plate 26 and the escutcheon plate 40 have been secured to the door 32. In this way, the security lock 10 of the present invention is adjustable for various size turn pieces and escutcheon plates. By way of example, the escutcheon plates 40 in FIGS. 4 and 8 are positioned substantially concentric with the mounting plates 26 in order for the abutting surfaces **22*a*, 22*b* of the arm 14 to be immediately adjacent the turn pieces 36***a* and 36*e*, respectively, when the arm 14 is in an engaged position.

Figure 5:
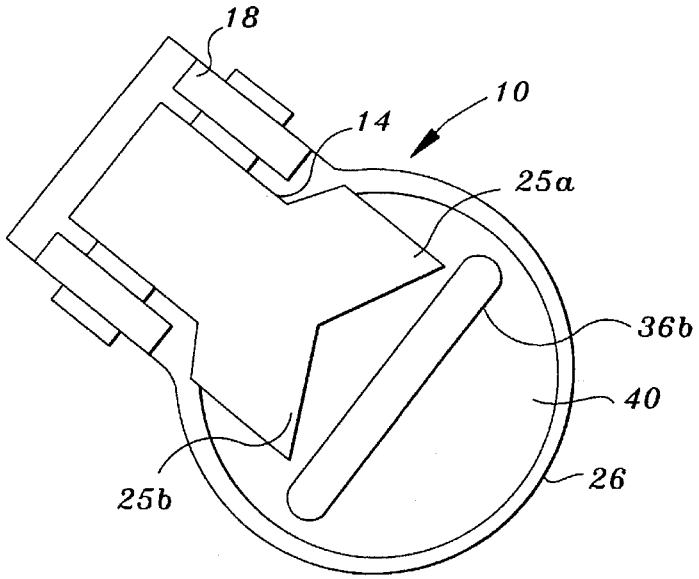
FIG. 5 is a top plan view of the security lock shown in FIGS. 1–3 with the arm in an engaged position with a lock assembly having a turn piece of a second style.

In contrast, the turn piece 36*b* in FIG. 5 is shaped such that the escutcheon plate 40 of the lock assembly must be positioned off-center on the mounting plate 26, away from the arm 14, such that the fins 25*a*, 25*b* are immediately adjacent the turn piece 36*b* when the arm 14 is in an engaged position.

Figure 6:
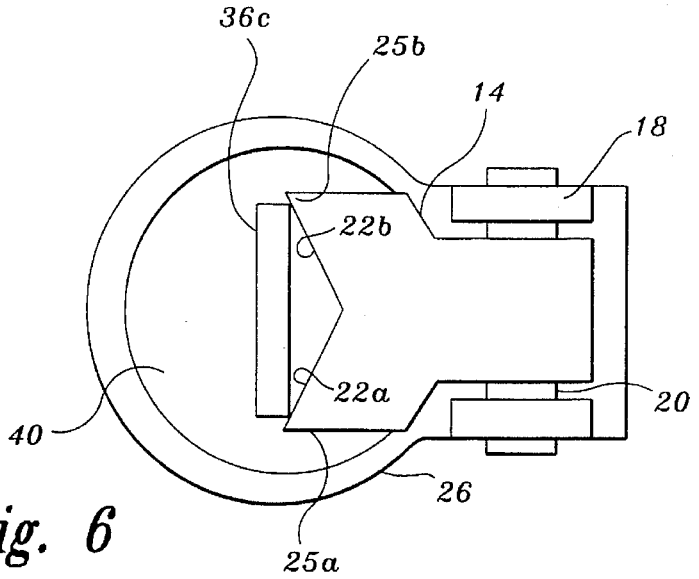
FIG. 6 is a top plan view of the security lock shown in FIGS. 1–3 with the arm in an engaged position with a lock assembly having a turn piece of a third style.

FIG. 6 illustrates yet another embodiment of a turn piece 36*c*. The security lock 10 and the escutcheon plate 40 are mounted such that the escutcheon plate 40 is off center of the mounting plate 26 toward the arm 14. This placement of the escutcheon plate 40 on the mounting plate 26 results in the abutting surfaces 22*a*, 22*b* being immediately adjacent the turn piece 36*c* when the arm 14 is in an engaged position. Any rotation in either clockwise or counterclockwise direction of turn piece 36*c* will be restricted by abutting surfaces 22*a* and 22*b*.

Figure 7:
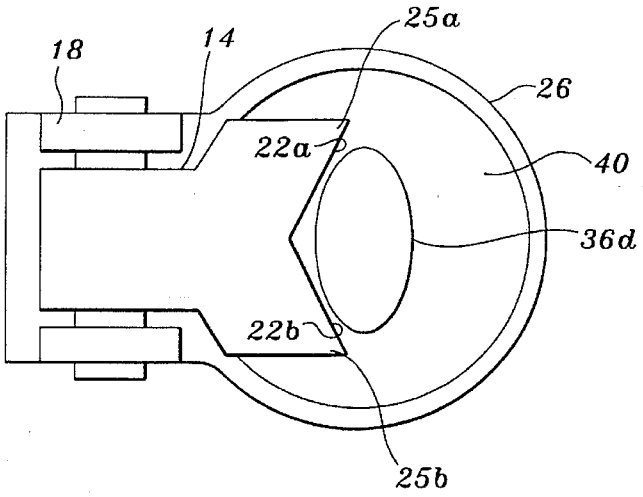
FIG. 7 is a top plan view of the security lock shown in FIGS. 1–3 with the arm in an engaged position with a lock assembly having a turn piece of a fourth style.

FIG. 7 shows yet another embodiment of the turn piece 36*d*. For this embodiment of the turn piece 36*d*, the escutcheon plate 40 and the mounting plate 26 are installed with escutcheon plate 40 off center of the mounting plate 26, away from the arm 14, such that the abutting surfaces 22*a*, 22*b* are immediately adjacent the turn piece 36*d* and prevent rotation of the turn piece 36*d* in either a clockwise or counter-clockwise direction.

Referring to FIG. 8, the escutcheon plate 40 is mounted substantially concentric with the mounting plate 26 such that the abutting surface 22*b* and the fin 25*a* are immediately adjacent the turn piece 36*e* when the arm 14 is in an engaged position. Rotational movement of the turn piece 36*e* in a clockwise direction is prevented by the turn piece 36*e* contacting abutting surface 22*b* and rotational movement of the turn piece 36*e* in a counter-clockwise direction is prevented by the turn piece 36*e* contacting fin 25*a*.

The engaged position of the arm 14 of the security lock 10 aligns the abutting surfaces 22*a*, 22*b* and fins 25*a*, 25*b* immediately adjacent the turn piece 36. Referring to FIGS. 2 and 3, in this configuration of a turn piece 36, there is about a 90 degree angle between the engaged position 42 of the arm 14 and the flange 18 such that the arm 14 is substantially parallel to the second side 38 of the door 32 when the abutting surfaces 22*a*, 22*b* are immediately adjacent the turn piece 36. Preferably the angle between the flange 18 and the arm 14 when the arm 14 is in an engaged position 42 is 90 degrees or less such that rotational forces of the turn piece 36 on the arm 14 do not move the arm 14 away from the door 32 and into a non-engaged position.

Figure 9:
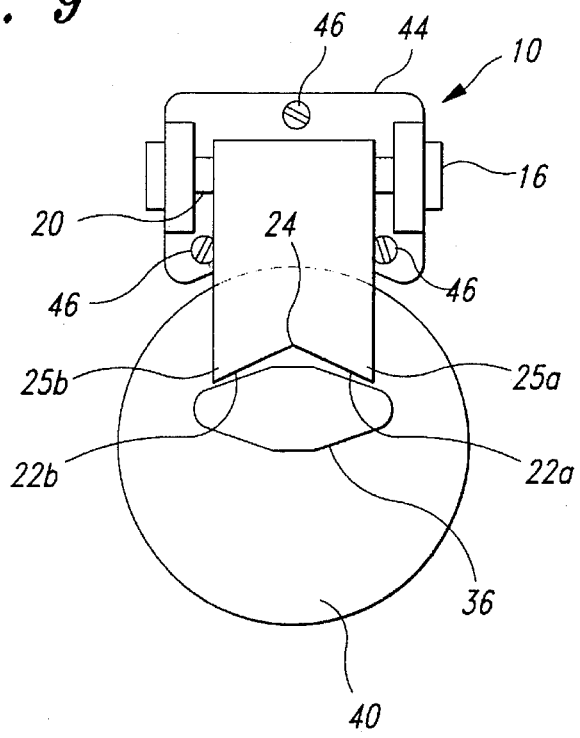
FIG. 9 is a top plan view of a second embodiment of the security lock of the present invention with the arm of the security lock shown in an engaged position with a turn piece of a lock assembly.

The present invention also provides a second embodiment of a security lock 10 as illustrated in FIG. 9. The second embodiment of the security lock 10 has a different style mounting member 12 than the first embodiment of the security lock 10. The mounting member 12 of the second embodiment includes a base 44 which has openings for receiving fasteners 46. The base 44 is secured to a second side 38 of a door 32 by inserting fasteners 46 through the openings in the base 44 and into the door 32. The base 44 is mounted on the door 32 such that when the arm 14 is in an engaged position, the turn piece 36 is immediately adjacent the abutting surfaces 22*a*, 22*b* and fins 25*a*, 25*b* of the arm 14 to prevent rotation of the turn piece 36 in either a clockwise or counter-clockwise direction.

Figure 10:
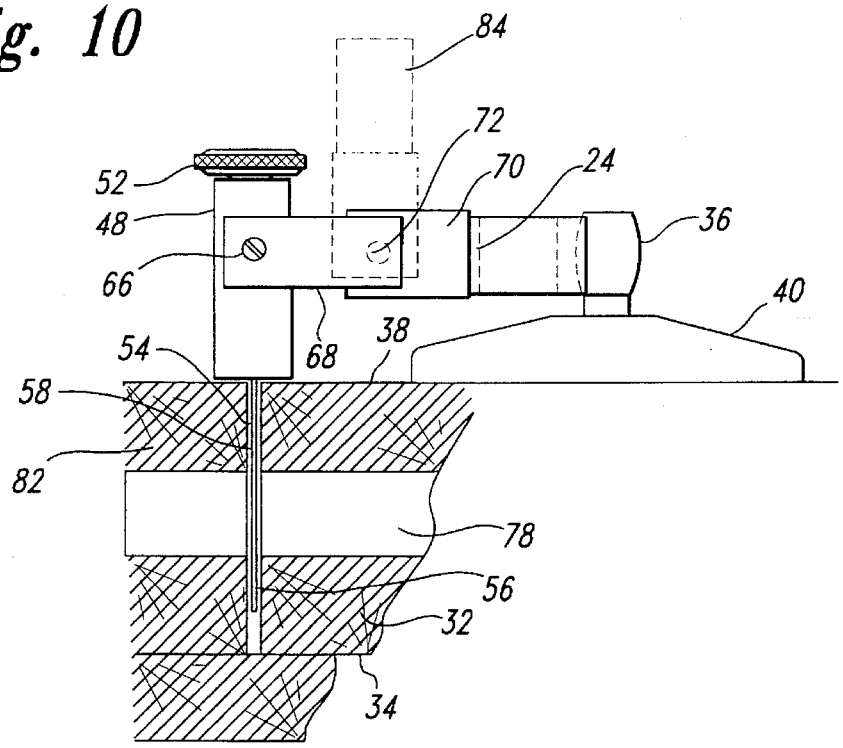
FIG. 10 is a side elevational fragmentary sectional view of a third embodiment of the security lock of the present invention mounted on a dead bolt extending from a door into a door jamb with an arm of the security lock in an engaged position with a turn piece of a lock assembly and the arm shown in a nonengaged position in phantom.
Figure 11:
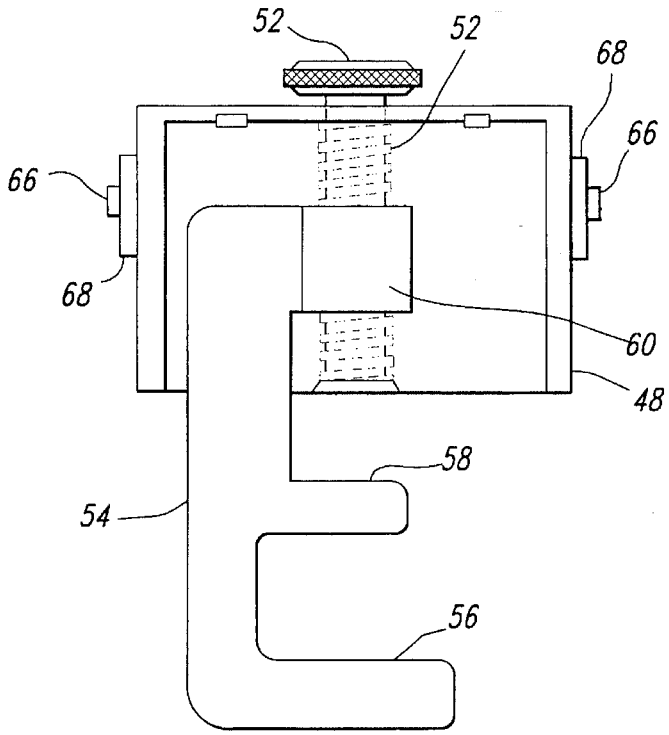
FIG. 11 is a rear elevational view of the security lock shown in FIG. 10 with a flap of a housing of the security lock removed.
Figure 12:
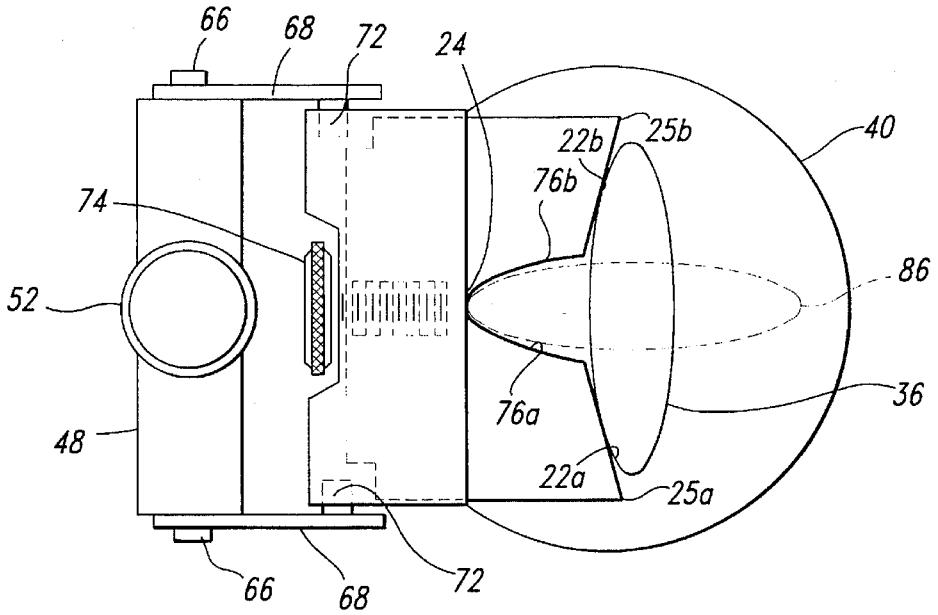
FIG. 12 is a top plan view of the security lock shown in FIGS. 10 and 11 with the arm shown in an engaged position with a turn piece of a dead bolt lock assembly.
Figure 13:
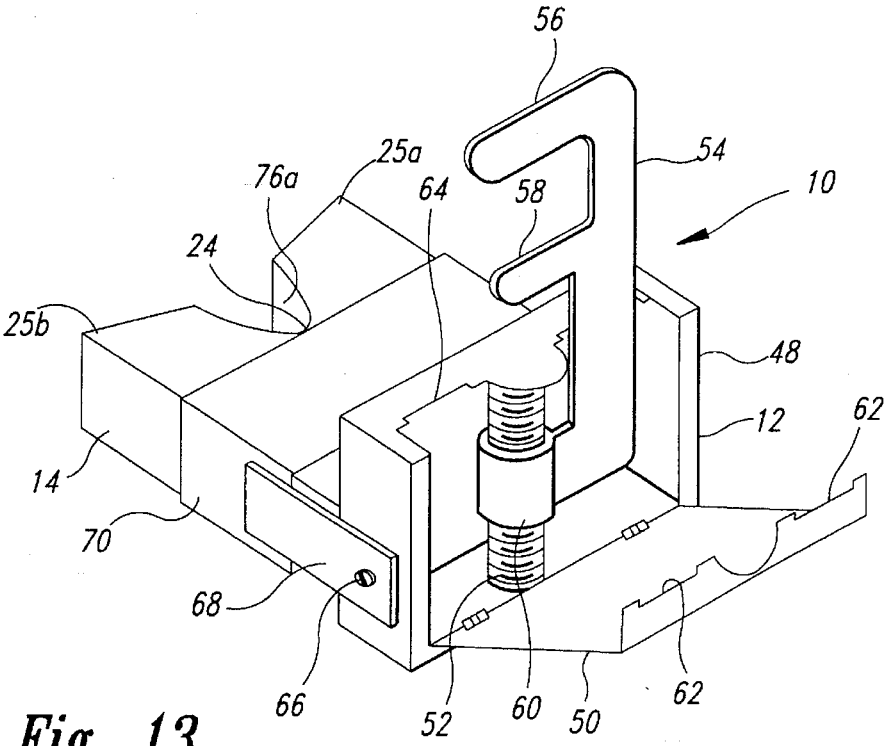
FIG. 13 is a pictorial view of the security lock shown in FIGS. 10–12 with the flap of the housing in an open position.

The present invention also provides a third embodiment which is illustrated in FIGS. 10–13. The mounting member 12 includes a housing 48 with a flap 50. The flap 50 is pivotal between an open position, as shown in FIG. 13, and a closed position, as shown in FIGS. 10 and 12. Located inside the housing 48 is a screw 52. A bolt-engaging finger 54 extends from the housing 48. The bolt-engaging finger 54 includes a first brace 56 and a second brace 58. The first brace 56 and second brace 58 are thin to permit the bolt-engaging finger 54 and braces 56, 58 to fit between a closed door 32 and door jamb 82. The bolt-engaging finger 54 further includes a nut 60 which is internally threaded (not shown) and is movable on the screw 52. The nut 60 on the screw 52 provides an adjustable portion for extending and retracting the bolt-engaging finger 54. The bolt-engaging finger 54 may be extended and retracted from the housing 48 by rotating the screw 52 such that the screw 52 passes over the nut 60. The flap 50 is formed with openings 62 and the housing is formed with mating openings 64 which permit the bolt-engaging finger 54 to project from the housing 48 in two positions. In the first position, as shown in FIG. 13, the bolt-engaging finger 54 extends from the housing 48 on the right side of screw 52 for use on a door opening on the left when facing the side of the door with the turn piece 36. The bolt-engaging finger 54 may be rotated approximately 180° to project from the housing 48 on the left side of the screw 52. These two positions of the bolt-engaging finger 54 permit the security lock 10 to be used on a door which opens from either the left or right when facing the side of the door which has a turn piece 36 mounted upon it.

Referring to FIGS. 10, 12 and 13, the mounting member 12 further includes a seat 70. The seat 70 and housing 48 are interconnected by appendages 68. The appendages 68 are attached to the housing 48 by fasteners 66 which extend through the appendages 68 into the housing 48. FIGS. 10 and 13 illustrate the appendages 68 positioning the seat 70 substantially perpendicular to the housing 48. The appendages 68 may be positioned at other angles relative to the housing 48 by loosening fasteners 66, adjusting the appendages 68, and then tightening fasteners 66.

Referring to FIGS. 10 and 12, the appendages 68 are connected to the seat 70 by pivot points 72. The pivot points 72 extend through openings in the seat 70 and permit rotation of the seat 70 relative to the appendages 68.

Referring to FIG. 12, the arm 14 is connected to the seat 70 by a rotating adjustable screw 74 which extends through the seat 70 and into the arm 14. The opening (not shown) in the arm 14 which receives the screw 74 includes internal threads which the screw 74 rotates upon. As the screw 74 is rotated, the screw passes over the internal threads of the arm 14 to extend and retract the arm 14 in and out of the seat 70 and provide an adjustable connection of the arm 14 to the seat 70.

The arm 14 includes abutting surfaces 22*a*, 22*b* which diverge from a central point 24 of the arm 14 such that fins 25*a*, 25*b* are formed on the arm 14, such as described for the first and second embodiments of the present invention. In addition, this embodiment of the arm 14 includes a second set of abutting surfaces 76*a*, 76*b* which extend from the central point 24 on the arm 14. Abutting surface 76*a* diverges from abutting surface 76*b* from the central point 24 of the arm 14. The second set of abutting surfaces 76*a*, 76*b* are particularly useful for preventing rotation of a turn piece 36 with a longitudinal length which is parallel to the longitudinal length of the arm 14, as illustrated in phantom at 86 in FIG. 12.

In use, the bolt-engaging finger 54 is adjusted by rotating the screw 52 on the nut 60 until the first brace 56 and the second brace 58 are aligned to fit over a dead bolt 78 when a door 32 is closed, as shown in FIG. 10. Adjustment of the bolt-engaging finger 54 by rotating the nut 60 on the screw 52 may be required depending upon which way the door 32 is positioned. The bolt-engaging finger 54 is positioned on the dead bolt 78 with the first brace 56 on one side of the dead bolt 78 and the second brace 58 on a second and opposite side of the dead bolt 78. The housing 48 is positioned on the second side 38 of the door 32, opposite the lock actuator (not shown) on the first side 34 of the door 32. The arm 14 is positioned relative to the turn piece 36 by turning the screw 74. The arm 14 is adjusted until the abutting surfaces 22*a*, 22*b* or 76*a*, 76*b* or fins 25*a*, 25*b* are positioned immediately adjacent the turn piece 36 to prevent the turn piece 36 from moving in either a clockwise or counter-clockwise direction, as shown in FIGS. 10 and 12. To disengage the arm 14, the arm 14 is pivoted about the pivot points 72 into a non-engaged position 84, as shown in phantom in FIG. 10.

Figure 14:
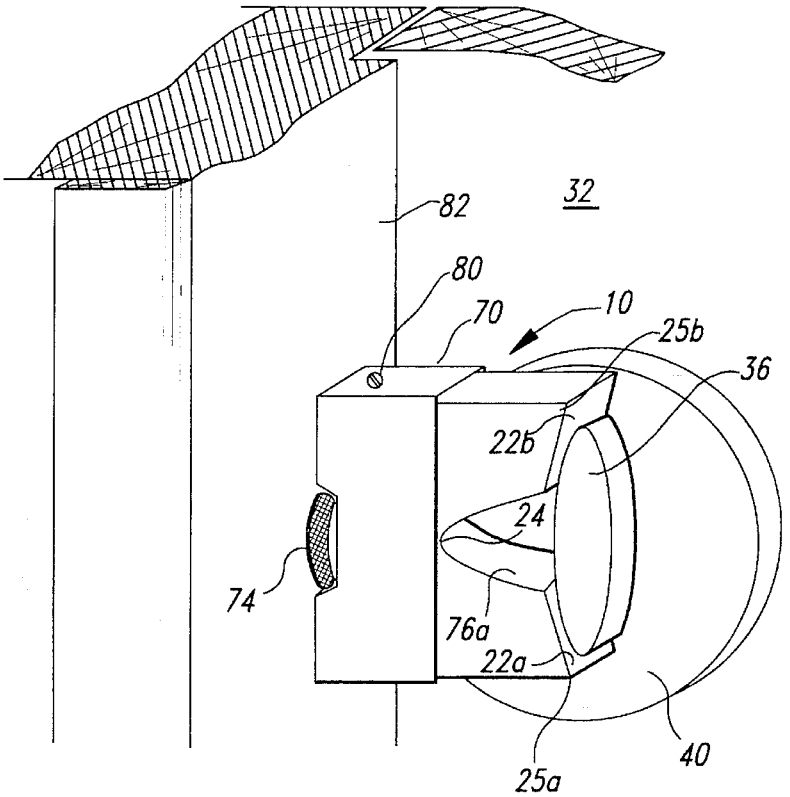
FIG. 14 is a partial fragmentary pictorial view of a fourth embodiment of the security lock of the present invention mounted on a door and a door jamb fitted with a dead bolt lock assembly having a turn piece.

Referring to FIG. 14, the present invention also provides a fourth embodiment of a security lock 10 which is mountable on a door 32 which includes a turn piece 36 on one side of the door which rotates when the dead bolt 78 is engaged or disengaged. The fourth embodiment of the security lock is preferably created by removing the housing 48 and appendages 68 from the security lock 10 shown in FIGS. 10–13. The housing 8 and appendages 68 are removed by pulling the appendages 68 away from the seat 70 such that the pivot points 72 come out of engagement with the seat 70. With the pivot points 72 removed from the seat 70, pivot point openings 80 formed in the seat 70 for receiving the pivot points 72 are visible. The security lock 10 shown in FIG. 14 may be mounted on a door 32 when the dead bolt 78 is not accessible.

In the fourth embodiment, the seat 70 provides the mounting member 12 for the security lock 10. The arm 14 is extended and retracted from the seat 70 by rotating the screw 74. In use, the security lock 10 is mounted by placing the seat 70 against a door jamb 82 and extending the arm 14 by adjusting the screw 74 until the abutting surfaces 22*a*, 22*b* or 76*a*, 76*b* or fins 25*a*, 25*b* are in contacting relationship with the turn piece 36. Rotational movement of the turn piece 36 will be restricted by the arm 14 which will result in forces against the door jamb 82, opposite the abutting surfaces 22*a*, 22*b*, 76*a*, 76*b* of the arm 14. Still referring to FIG. 14, the security lock 10 may be moved into a non-engaged position by rotating the screw 74 until the arm 14 is brought out of engagement with the turn piece 36.

The third and fourth embodiments of the present invention, shown in FIGS. 10–14, are especially adaptable for use when travelling since the adjustable portions on the security locks 10 permit their use on a variety of doors with various styles of the turn pieces. The fourth embodiment may be constructed as a security lock 10, but preferably the third embodiment is convertible to the fourth embodiment to provide a traveler with a security lock 10 for almost any style door with a dead bolt lock assembly.

It is to be understood that many variations in size, shape, and construction can be made to the illustrated and above-described embodiments without departing from the spirit and scope of the present invention. Some of the features of the preferred embodiments may be utilized without other features. Therefore, it is to be understood that the presently described and illustrated embodiments is non-limitive and is for illustration only. Instead, my patent is to be limited for this invention only by the following claim or claims interpreted according to accepted doctrines of claim interpretation, including the doctrine of equivalence and reversal of parts.

What is claimed is:

1. A security lock for use with a lock assembly mounted on a door, said lock assembly having a lock actuator on a first side of said door and a turn piece on a second opposite side of said door, said turn piece being rotatably connected to a dead bolt of said lock assembly and activation of said dead bolt by said lock actuator causing rotation of said turn piece, comprising:

a mounting member; and an arm having a pivotal connection to said mounting member at a first end of said arm, said arm being pivotal about said pivotal connection between an engaged position and a nonengaged position, said arm having abutting surfaces at a second and opposite end of said arm, each said abutting surface diverging from each other abutting surface from a central point such that said abutting surfaces form a notch in the second end of said arm with an angle between the abutting surfaces of less than 180 degrees said abutting surfaces intersecting longitudinally extending edge surfaces of said arm which substantially extend along the entire length of the arm, said arm having a longitudinal length and said pivotal connection being substantially perpendicular to said longitudinal length of said arm;

wherein in use said security lock is mountable on a door by mounting said mounting member to position said abutting surfaces adjacent a turn piece of a lock assembly when said arm is in its engaged position such that said abutting surfaces abut and restrict rotation of said turn piece.

2. The security lock of claim 1, wherein said mounting member comprises:

a mounting plate forming a circular cavity, said circular cavity being sized to receive a portion of said lock assembly;

an escutcheon plate receiving surface extending radially outwardly from said circular cavity, wherein said security lock is mountable on a door by placing said mounting plate between said door and an escutcheon plate of said lock assembly such that said escutcheon plate is positioned flush against said mounting plate and said mounting plate is positioned flush against said door.

3. The security lock of claim 1, wherein said mounting member includes a bolt-engaging finger, said bolt-engaging finger being dimensioned to permit said bolt-engaging finger to be positioned between a closed door and door jamb, wherein in use, said security lock is mountable on a door by fitting said bolt-engaging finger on a dead bolt of a lock assembly installed on the door when the dead bolt is in a locked and extended position.

4. The security lock of claim 1, wherein said security lock includes an adjustable connection to extend and retract the abutting surfaces of the arm, wherein in use said adjustable connection is adjustable to place the abutting surfaces of the arm immediately adjacent a turn piece of a lock assembly installed on a door when the arm is in the engaged position.

5. The security lock of claim 1, wherein said mounting member is mountable on a door by use of fasteners which extend through openings formed in said mounting member and into said door.

6. The security lock of claim 1, wherein said arm further includes a secondary notch which is formed by a secondary set of surfaces which diverge from another central point in the arm, wherein in use, said secondary notch prevents rotation of a turn piece which has a longitudinal length substantially parallel to the length between the first end and the second end of the arm when the arm is in an engaged position.

7. A security lock for use with a lock assembly mounted on a door, said lock assembly having a lock actuator on a first side of said door and a turn piece on a second opposite side of said door, said turn piece being rotatably connected to a dead bolt of said lock assembly and activation of said dead bolt by said lock actuator causing rotation of said turn piece, comprising:

a mounting member, said mounting member including a bolt-engaging finger, said bolt-engaging finger being dimensioned to permit said bolt-engaging finger to be positioned between a closed door and door jamb, said bolt-engaging finger further including an adjustable portion, said adjustable portion being adjustable to extend and retract the bolt-engaging finger from a housing of the mounting member, an arm having a pivotal connection to said mounting member at a first end of said arm, said arm being pivotal about said pivotal connection between an engaged position and a nonengaged position, said arm having abutting surfaces at a second and opposite end of said arm, each said abutting surface diverging from each other abutting surface such that said abutting surfaces form a notch in the second end of said arm with an angle between the abutting surfaces of less than 180 degrees, said arm having a longitudinal length and said pivotal connection being substantially perpendicular to said longitudinal length of said arm;

wherein in use said bolt-engaging finger is adjustable such that said security lock is mountable on a door by fitting said bolt-engaging finger and placing said bolt-engaging finger over a dead bolt of a lock assembly installed in a door with the abutting surfaces of the arm immediately adjacent a turn piece of the lock assembly when the arm is in the engaged position such that said abutting surfaces abut and restrict rotation of said turn piece.

8. A security lock for use with a lock assembly mounted on a door, said lock assembly having a lock actuator on a first side of said door and a turn piece on a second opposite side of said door, said turn piece being rotatably connected to a dead bolt of said lock assembly and activation of said dead bolt by said lock actuator causing rotation of said turn piece, comprising:

a mounting member; said mounting member including a bolt-engaging finger detachably connectable to a seat, said seat being mountable on a door by positioning said seat against a door jamb of the door; and an arm having a pivotal connection to said mounting member at a first end of said arm, said arm being pivotal about said pivotal connection between an engaged position and a nonengaged position, said arm having abutting surfaces at a second and opposite end of said arm, each said abutting surface diverging from each other abutting surface such that said abutting surfaces form a notch in the second end of said arm with an angle between the abutting surfaces of less than 180 degrees, said arm having a longitudinal length and said pivotal connection being substantially perpendicular to said longitudinal length of said arm;

wherein in use, said security lock is mountable on a door by fitting said bolt-engaging finger on a dead bolt of a lock assembly installed on the door when the dead bolt is in a locked and extended position to position said abutting surfaces adjacent a turn piece of a lock assembly when said arm is in its engaged position such that said abutting surfaces abut and restrict rotation of said turn piece, and said security lock is mountable on a door by detaching said bolt-engaging finger from the seat and mounting said security lock by positioning said seat against a door jamb of a door and said abutting surfaces of the arm immediately adjacent a turn piece of a lock assembly installed on the door when the arm is in the engaged position such that said abutting surfaces abut and restrict rotation of said turn piece.

9. The security lock of claim 8, wherein said security lock includes an adjustable connection to extend and retract the abutting surfaces of the arm, wherein in use said adjustable connection is adjustable to place the abutting surfaces of the arm immediately adjacent a turn piece of a lock assembly installed on the door when the arm is in the engaged position.

10. The security lock of claim 8, wherein said arm further includes a secondary notch which is formed by a secondary set of surfaces which diverge from a central point in the arm, wherein in use, said secondary notch prevents rotation of a turn piece which has a longitudinal length substantially parallel to the length between the first end and the second end of the arm when the arm is in an engaged position.

* * * * *